United States Patent [19]

Yamada

[11] Patent Number: 4,887,091

[45] Date of Patent: Dec. 12, 1989

[54] BROADCASTING RECEIVER FOR VEHICLES

[75] Inventor: Takahiro Yamada, Tokyo, Japan

[73] Assignee: Aisin Seiki Kabushiki Kaisha, Aichi, Japan

[21] Appl. No.: 170,506

[22] Filed: Mar. 21, 1988

[30] Foreign Application Priority Data

Mar. 19, 1987 [JP] Japan ..... 62-039174[U]

[51] Int. Cl.[4] ..... H01Q 1/12; H01Q 3/08

[52] U.S. Cl. ..... 343/714; 343/763; 343/781 CA; 343/882

[58] Field of Search ..... 343/713, 714, 712, 711, 343/882, 781 P, 763, 765, 766, 781 CA, 837, 840

[56] References Cited

U.S. PATENT DOCUMENTS 3,914,768 10/1975 Ohm ..... 343/779

FOREIGN PATENT DOCUMENTS 260204 12/1985 Japan ..... 343/713
260206 12/1985 Japan ..... 343/713
260207 12/1985 Japan ..... 343/713
100005 5/1986 Japan .

*Primary Examiner*—Rolf Hille
*Assistant Examiner*—Michael C. Wimer
*Attorney, Agent, or Firm*—Sughrue, Mion, Zinn, Macpeak & Seas

[57] ABSTRACT

A broadcasting receiver for vehicles especially suited for receiving satellite broadcasting signals comprises a base plate rotatable horizontally, a main reflector tiltably attached to the base plate, a sub-reflector attached to the end portion of an arm of which the other end is attached to the base plate so as to be rotatable horizontally, and a signal detector fixed to the main reflector. The vertical angle between the main reflector and the arm are maintained at a predetermined angle, and the sub-reflector which is arranged to be rotatable around the end portion of the arm is caused to stand up when the main reflector is in a stand up position. All devices and parts arranged on the base plate including the arm and the sub-reflector are covered by the main reflector when the main reflector is turned down.

9 Claims, 7 Drawing Sheets

BROADCASTING RECEIVER FOR VEHICLES

BACKGROUND OF THE INVENTION

1. Field of the Invention

This invention relates to a broadcasting receiver for vehicles, and more particularly to a receiver to be located on a vehicle capable of receiving satellite broadcasting.

2. Description of the Prior Art

A widely known conventional receiver for a vehicle to receive television broadcasting of VHF band comprises a diversity antenna combining monopole antennas mounted on a car body. This type of receivers, however, are considerably vulnerable to ghost disturbances echoed from buildings, mountains and so on. Further, as carrying cars incessantly move about from one spot to another, it is difficult to steadily assure good reception.

To solve the above problem, receivers for vehicles to steadily assure good reception irrespective of the receiving spot by receiving direct signal waves of satellite broadcasting have been proposed, for example, in Japanese Laid-open Patent Publications Nos. 260204, 260206 and 260207 of 1985 (Toku-kai-sho 60-260204, 260206 and 260207).

The proposed receivers for vehicles have common basic components as shown in FIG. 11. The receiver shown in FIG. 11 comprises a pair of bearings 12 fastened to a mounting panel 11 of a car body. The bearings 12 rotatably support a support member 13 to which a coupling box 16 is fastened. A main reflector 1 and an arm 9 are fastened to a coupling plate 7 mounted on the coupling box 16. The arm 9 extends like a fork having two prongs, with a converter 2 fastened to the tip thereof. To the support member 13 is attached a dual-pronged guide 14, with the tips of the prongs slidably fitted in guide rails 15 that are disposed parallel to each other. The coupling plate 7 mounted on the coupling box 16 permits the main reflector 1 and arm 9 to rotate through a given angle in a plane parallel to the mounting panel 11 and also to rotate through a given angle at that point in a plane perpendicular to the mounting panel 11.

When out of use, the reflector 1 and arm 9 can be collapsed toward the mounting panel 11 by turning the support member 13 in the bearings 12 and sliding the guide 14 along the guide rails 15.

When put to use, the horizontal and vertical position of the main reflector 1 are fixed by erecting the support member 13 and turning the coupling plate 7 horizontally and vertically as desired with respect to the coupling box 16. The main reflector 1 thus horizontally and vertically positioned focuses radio waves from a broadcasting satellite to the converter 2. The radio waves admitted into a primary radiator in the converter 2 are converted by a circular-linear polarizer therein. The converter then converts signals of the 12 GHZ band into BS-IF signals of the 1 GHZ band, thus completing the reception of satellite broadcasting.

Collapsing the main reflector 1 and arm 9 out of use toward the mounting panel 11 by turning the support member 13 keeps the antenna assembly from getting damaged by the wind pressure and other external forces to which the assembly is likely to be exposed while traveling.

With the conventional receivers for vehicles of the proposed type, the arm 9 must be pronged to have enough strength to carry the considerably heavy converter 2 at the tip thereof. Also, the coupling plate 7 and supporting member 13 must be large enough to withstand the large moment set up by the converter 2 and arm 9. Furthermore, large enough driving force corresponding to such large moment to set the main reflector in the desired horizontal and vertical positions in use and turn the support member 13 for collapsing the assembly out of use. Motorpowered automatic drive requires a motor of large capacity, which, in turn, increases not only power consumption but also the size of the whole assembly.

Even in the collapsed condition, a considerably large portion of the antenna stands up from the mounting panel, with not a few components thereof remaining bare and exposed. Therefore, the antenna assembly is exposed to the wind pressure when the car is running and some part or parts thereof might get hit and damaged by some obstacle. Moreover, a signals transmitting cord connecting the converter to the inside of the vehicle would be easily damaged by repeated twisting actions brought by the rotation of the antenna.

BRIEF SUMMARY OF THE INVENTION

The object of this invention is to provide a receiver for a vehicle designed to materially reduce the antenna driving force and the size of the whole assembly by reducing the turning moment of the antenna arm, with the main reflector adapted to contain the components of the antenna and cover the support member thereof when the antenna is folded.

To achieve the above object, a receiver for a vehicle according to this invention comprises a tiltable main reflector serving as an antenna to receive signals from a broadcasting signal, an arm rotatably attached to a support carrying a sub-reflector, and a converter fastened to the main reflector. When collapsed, the arm and sub-reflector come in contact with the support which is substantially totally covered with the streamlined main reflector that contains the arm and sub-reflector therein. Namely, the receiver comprises a support rotatable parallel to the mounting panel of the car body, a main reflector and an arm attached to the support in such a manner as to be rotatable in a plane perpendicular to the mounting panel, a sub-reflector fastened to the forward end of the arm, and a converter fastened to the main reflector, the main reflector covering substantially the entirety of the support while containing the arm and sub-reflector which are brought into contact with the support when the main reflector is turned down. Further, when the main reflector is turned toward the mounting panel of the car body to fold down the antenna, the arm turns in the same direction while being urged by a spring, with the sub-reflector turning on coming in contact with the mounting panel whereby the arm and sub-reflector are contained within the main reflector. The main reflector thus folded and containing the arm and sub-reflector covers substantially the entirety of the antenna support.

The construction that an arm rotatably attached to a support carries only a sub-reflector reduces the turning moment of the arm, lessens the force required for turning the arm, and reducing the size of the entire assembly. When the antenna is folded, the arm and sub-reflector are brought into contact with the support and contained in the main reflector having a streamlined contour that covers substantially the entirety of the support and protects the internal components.

Another object of the present invention is to provide a receiver for a vehicle in which the cord connecting the converter and the inside of the vehicle is not damaged by the rotation of the antenna, by using a device which acts so as to untwist the cord in the direction against the twisting action brought by the rotation of the antenna, thereby making it possible to rotate the antenna repeatedly over an angle of 360°.

Another object of the present invention is to provide a receiver for a vehicle in which the angle between the main reflector and the arm are set up with the standing-up movement of the antenna so that the best receiving sensitivity is obtained, by using an angle adjusting device which is of simple construction and easily operable.

The foregoing and other objects, features and advantages of the present invention will be understood more clearly and fully from the following detailed description of preferred embodiments with reference to the attached drawings.

DETAILED DESCRIPTION OF THE PREFERRED EMBODIMENTS

Referring now to FIGS. 1 to 10, a preferred embodiment of this invention will be described in detail.

Figure 2:
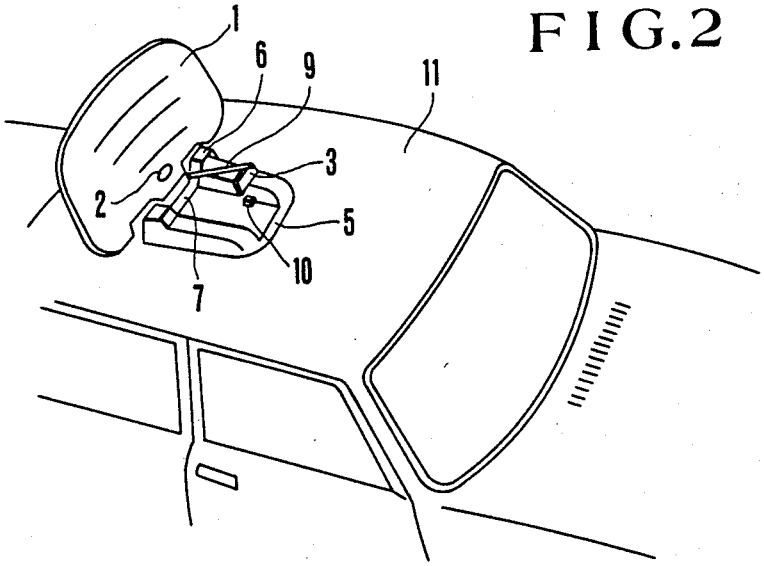
FIG. 2 and 3 show perspective views of the receiver of the invention when it is mounted on a vehicle, FIG. 2 showing it in the receiving condition and FIG. 3 showing it in the folded condition.

FIG. 2 is a perspective view showing a preferred embodiment of this invention in receiving condition. A cover 5 is rotatably fitted on a mounting roof panel 11 of a vehicle. A coupling plate 7 is fitted on a rotatable shaft 6 at one end of the cover 5, with a main reflector 1 fastened to the coupling plate 7. The shaft 6 also rotatably carries an arm 9 which carries a sub-reflector 3 at the tip thereof in such a manner as to be rotatable about an axis perpendicular to the arm 9. A converter 2 is inset across the reflector 1 near the shaft 6.

Figure 3:
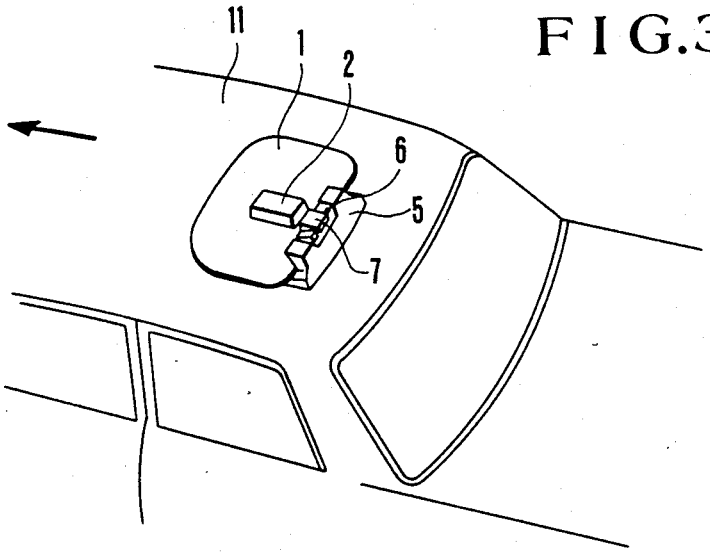

The components are disposed so that, in the receiving condition shown in FIG. 2, radio waves from a broadcasting satellite reflected by the main reflector 1 are focused to the sub-reflector 3 which, in turn, reflects the radio waves into the converter 2. FIG. 3 shows a condition in which the main reflector 1 and arm 9 are turned down about the shaft 6 and folded. In this condition, the folded main reflector 1 contains the arm 9 and sub-reflector 3, covers the cover 5, and lies over the mounting panel 11.

Figure 1:
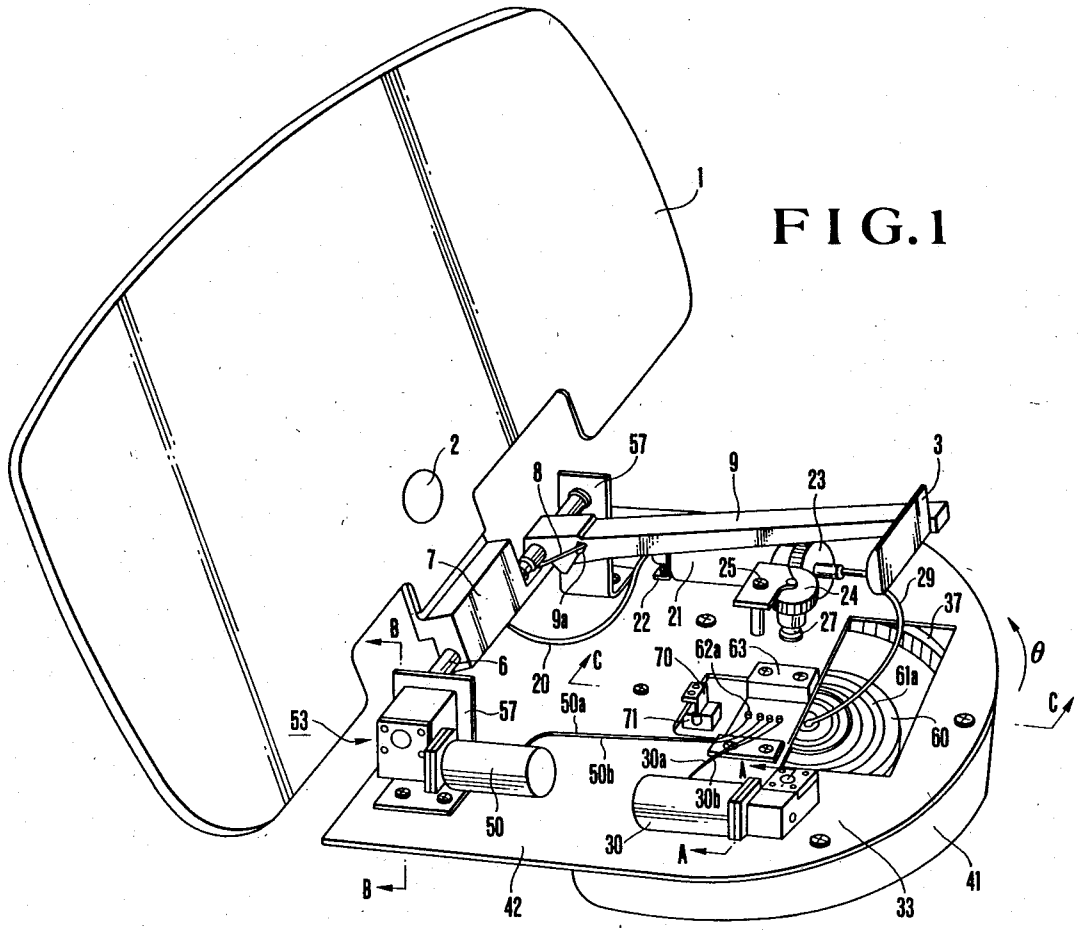
FIG. 1 shows a perspective view of the principal part of one embodiment of this invention.

FIG. 1 is a perspective view showing the principal part of the preferred embodiment. To reveal the internal structure, the cover 5 shown in FIGS. 2 and 3 is removed. As is shown in FIG. 1, a turning plate 42 is fastened to an annular block 41 to form, in combination, a support. Spaced brackets 57 facing each other are fastened to one end of the turning plate 42, rotatably supporting a shaft 6 therebetween. A gear box 53 is fastened to one of the brackets 57, and one end of the shaft 6 is admitted and coupled therein.

Figure 5:
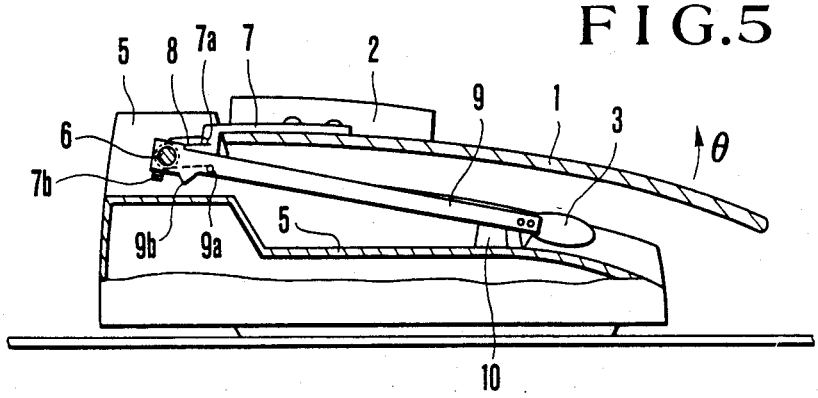
FIG. 5 shows the side elevational view partly in section of the receiver of FIG. 1 in the folded condition.
Figure 7:
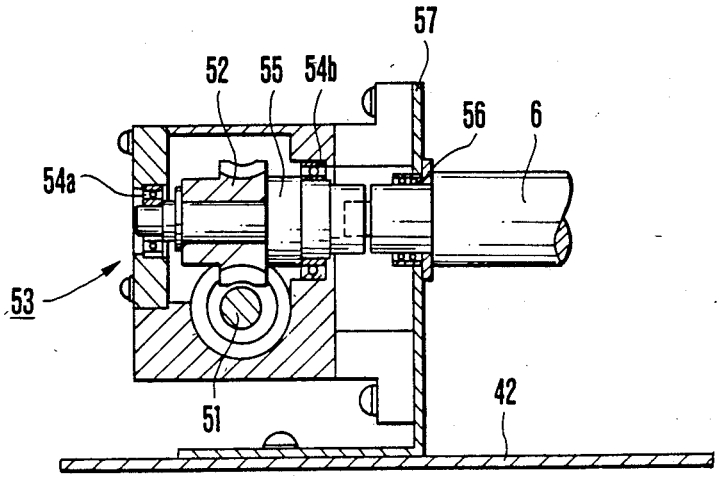
FIG. 7 shows a cross-sectional view taken along the line B—B of FIG. 1.
Figure 8:
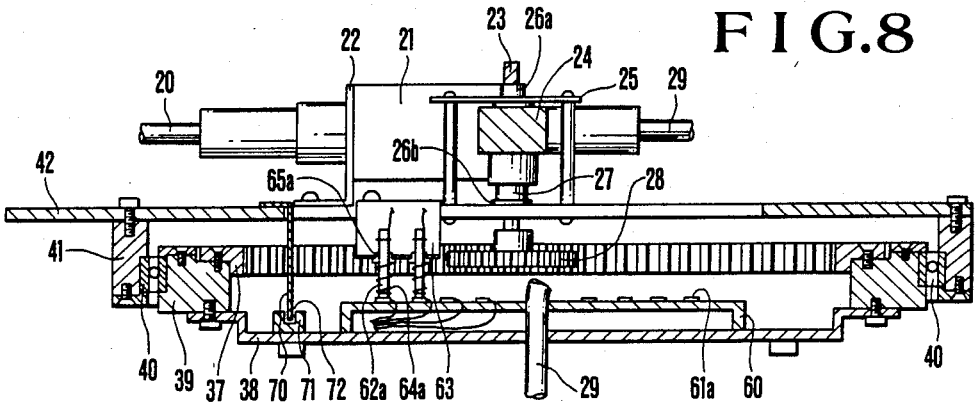
FIG. 8 shows a cross-sectional view taken along the line C—C of FIG. 1.
Figure 10:
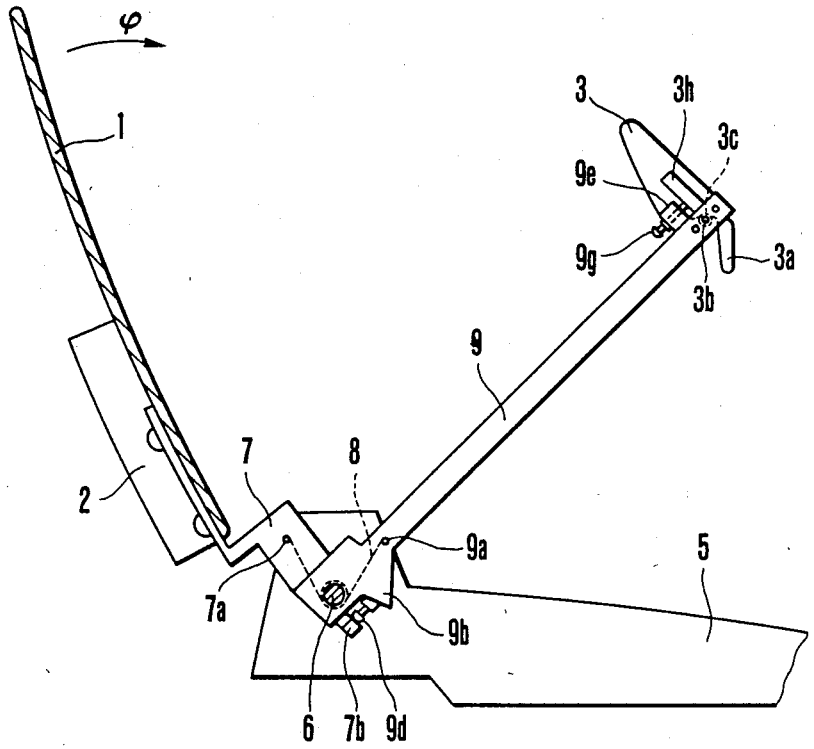
FIG. 10 shows a partially enlarged view of FIG. 4.
Figure 11:
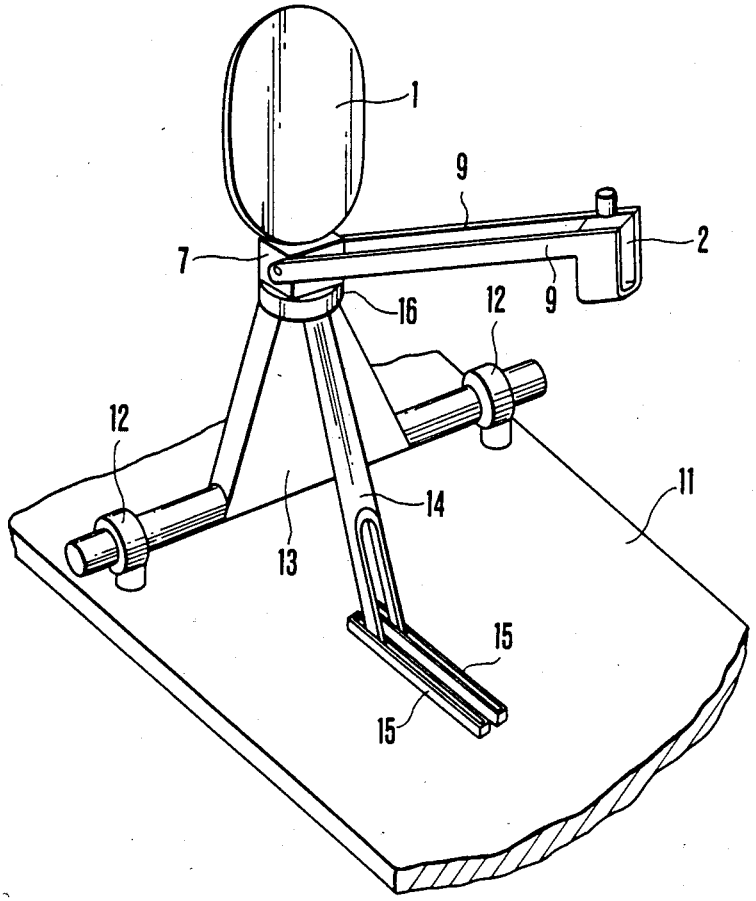
FIG.11 PRIOR ART
FIG. 11 shows a perspective view showing the structure of a conventional receiver for vehicles.

FIG. 7 shows how the shaft 6 is coupled in the gear box 53. A worm 51 is press fit in the rotating shaft of a vertical-drive motor 50 attached to the gear box. The worm 51 is engaged with a worm wheel 52 to which a shaft 55 is fastened. The shaft 6 is fastened to the shaft 55. One end of the shaft 55 is rotatably supported by the gear box 53 by means of a bearing 54*a*, while the other end thereof is also rotatably supported by the gear box 53 by means of a bearing 54*b*. One end of the shaft 6 is rotatably supported by the gear box 53 by means of a bearing 56. The coupling plate 7 carrying the main reflector 1 is fastened to the shaft 6 rotatably supported between the brackets 57. The rotatable arm 9 is also attached to the shaft 6. A spring 8 is interposed between a projection 7*a* on the coupling plate 7 and a projection 9*a* on the arm 9 as shown in FIGS. 5 and 10. As is shown in FIG. 10, the coupling plate 7 also has another projection 7*b* and the arm 9 also has a contact projection 9*b*. An adjusting screw 9*d* capable of projecting length adjustment is fitted to the contact projection 9*b*. To the tip of the arm 9 is attached a shaft 3*b* which pivotally supports the sub-reflector 3. A projection 3*a* integrally formed with the sub-reflector 3 projects from the arm 9 on the opposite side of the sub-reflector 3. The arm 9 has a projection 9*e* into which an adjusting screw 9*g* is screwed to permit the projection length of its own. The adjusting screw 9*g* is held in contact with a pressure plate 3*h* on the sub-reflector 3. A spring 3*c* is interposed between the projections 9*e* and 3*a* to vertically urge the sub-reflector 3.

As the vertical-drive motor 50 turns the shaft 6, the main reflector 1 is vertically brought into a desired angular position. The projection 7*b*, adjusting screw 9*d*, contact projection 9*b* and spring 8, in combination, make up an angle holding mechanism. The projection 7*b* comes in contact with the contact projection 9*b* through the adjusting screw 9*d*, whereupon the spring 8 keeps the main reflector 1 and arm 9 in the desired angular position. Also, the spring 3*c* keeps the sub-reflector 3 erected toward the projection 9*e* as adjusted by the adjusting screw 9*g*. The vertical-drive motor 50 is also capable of tilting the main reflector 1 in the folding direction toward the turning plate 42. On this occasion, the arm 9 also turns with the main reflector 1 in the same direction until the projection 3*a* touches the cover 5, whereupon the sub-reflector 3 gets folded as indicated by a dash-and-two-dots line in FIG. 4. The arm 9 then comes in contact with a stopper 10 on the cover 5.

Figure 6:
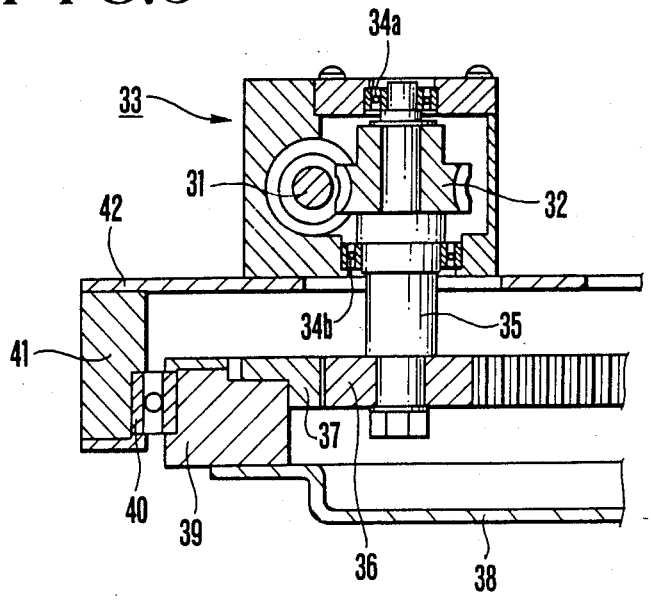
FIG. 6 shows a cross-sectional view taken along the line A—A of FIG. 1.

A rotatable block 41 is attached to an annular stationary block 39 through bearings 40. The bottom of the stationary block 39 is closed with a stationary plate 38. As shown in FIGS. 1 and 6, a gear box 33 is fastened to the turning plate 42, with the rotating shaft of a horizontal-drive motor 30 is connected to the gear box 33. The rotating shaft of the horizontal-drive motor 30 is press fit in a worm 31 which is engaged with a worm wheel 32. The worm wheel 32 is coupled to a shaft 35. Both ends of the shaft 35 are supported by the gear box 33 by means of bearings 34a and 34b. The shaft 35 projects through the turning plate 42, with a gear 36 fastened to the projected end thereof. The gear 36 is meshed with an internal gear 37 fastened to the inner surface of the annular stationary block 39.

A hollow disk-like ring support 60 is mounted on the stationary plate 38. The ring support 60 carries coaxially disposed rings 61a of conductive material thereon. Voltage is fed to the rings 61a from the power supply in the vehicle. A brush-support plate 63 is fastened to the turning plate 42 in such a manner as to face the ring support 60. The brush-support plate 63 carries brushes 62a through bushes 65a. The brushes 62a are held in contact with the rings 61a. A spring 64a presses each brush 62a against the ring 61a. Power supply cords 50a, 50b and 30a, 30b leading to the vertical-drive motor 50 and horizontal-drive motor 30 are connected to the brushes 62a. Thus, power is stably supplied to the vertical-drive motor 50 and horizontal-drive motor 30 irrespective of the angular position of the turning plate 42. As described previously, the shaft 35 driven by the horizontal-drive motor 30 brings the gear 36 into engagement with the internal gear 37 fastened to the stationary block 39. Therefore, the horizontal-drive motor 30 turns the turning plate 42 around the stationary plate 38 fastened to the vehicle.

A cord 29 to transmit electrical signals to the vehicle side is connected to the converter 2 on the main reflector 1 together with a means to prevent the twisting thereof. A cord 20 from the converter 2 is connected to one end of a rotary joint 21 mounted on the turning plate 42 by means of a bracket 22. The cord 29 passed through the ring support 60 is fastened to a screw gear 23 attached to the other end of the rotary joint 21. Thus, the rotary joint 21 electrically connects the cords 20 and 29.

An adapter plate 25 is fastened to the turning plate 42 near the screw gear 23. A bearing 26a on the adapter plate 25 and a bearing 26b on the turning plate 42 rotatably support a screw gear 24 which is meshed with the screw gear 23. The shaft 27 of the screw gear 24 extends to carry a gear 28 fastened to the tip thereof. The gear 28 is engaged with the internal gear 37. As the horizontal-drive motor 30 turns the turning plate 42 once, the screw gear 23 turns so that the cord 29 turns once about the axis thereof at the point where the cord 29 is attached to the ring support 60 in the direction opposite to the rotating direction of the turning plate 42.

A light sensor 71 is fastened to the stationary plate 38. The light sensor 71 has a groove 72 through which a shutter 70 fastened to the turning plate 42 passes as the turning plate 42 rotates. The main reflector 1 is adapted to face forward in the direction, indicated by an arrow in FIG. 3, in which the vehicle advances when the shutter 70 fits in the groove 72 to cut off a beam of light reaching the light sensor 71.

In the followings, the operation of the preferred embodiment of this invention will be described.

Figure 4:
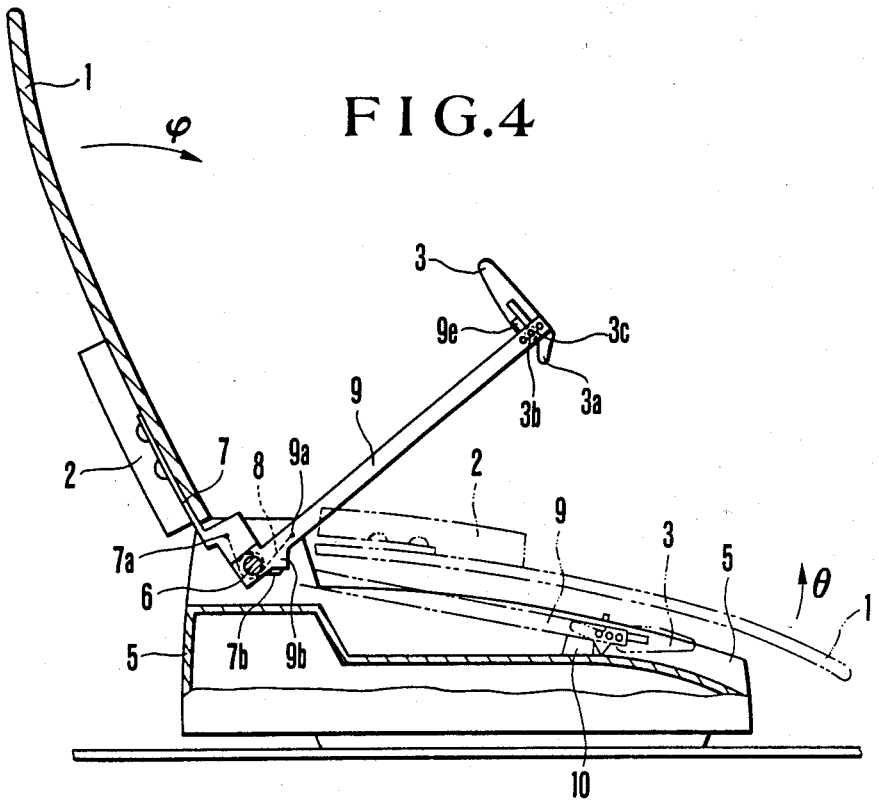
FIG. 4 shows the side elevational view partly in section of the receiver of FIG. 1 in the working condition.

The main reflector 1 and arm 9 are first folded as shown by a dash-and-two-dots line in FIG. 4. As the vertical-drive motor 50 starts, the main reflector 1 begins to rise in the direction indicated by arrow $\theta$. When the main reflector 1 has turned through a given angle, the projection 7b comes into engagement with the contact projection 9b on the arm 9 through the adjusting screw 9d, whereupon the projection 7b pushes up the arm 9. Thus, the main reflector 1 and arm 9 move up to a given position while maintaining a given angle therebetween. When the projection 3a under the sub-reflector 3 leaves the cover 5, the urging force of the spring 3c erects the sub-reflector 3 on the arm 9.

The horizontal-drive motor 30 also moves simultaneously with the vertical-drive motor 50 to turn the shaft 35 which brings the gear 36 into engagement with the internal gear 37 fastened to the stationary block 39 and thereby rotates the turning plate 42. Consequently, the entirety of support assembly including the cover 5 is turned to a given angular position in a horizontal plane parallel to the mounting panel 11.

Figure 9:
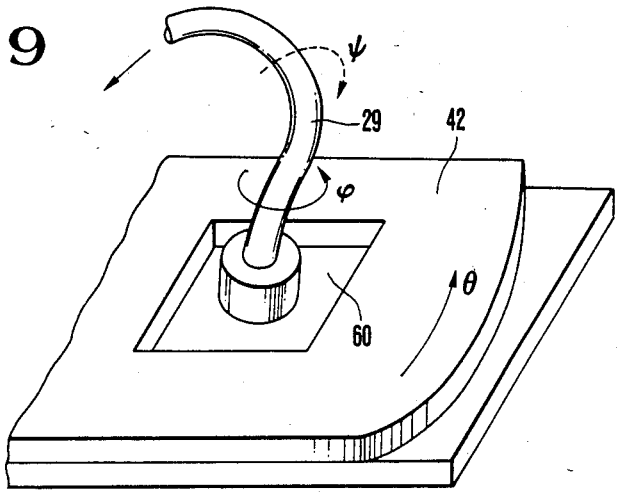
FIG. 9 shows a perspective view illustrating the principle of untwining a twisted cord.

When the rotation in the direction $\theta$ shown in FIG. 1 takes place, a force works to twist the cord 29, which extends from the ring support 60 substantially perpendicularly thereto, about the axis thereof in direction $\psi$ as shown in FIG. 9. The twisting force is such that the cord 29 turns through 360 degrees about the axis thereof as the turning plate 42 makes a full turn. However, the rotation of the turning plate 42 brings the gear 28 into engagement with the internal gear 37, whereupon the shaft 27 turns to rotate the screw gear 23 meshed with the screw gear 24 fastened thereto. Thus, the cord 29 turns in direction $\psi$ in FIG. 9. As the screw gear 23 is set to turn once as the turning plate 42 turns once, an untwining force invariable works on the cord 29 twisted by the rotation of the turning plate 42. Thus, the cord 29 remains untwisted even if the turning plate 42 turns. When the turning plate 42 turns in the opposite direction, the cord 29 also remains untwisted as the screw gear 23 similarly turns in the opposite direction. As the turning plate 42 rotates, the brushes 62a slide over the rings 61a while keeping contact therewith, thereby maintaining stable power supply to the vertical-drive motor 50 and horizontal-drive motor 30.

The main reflector 1 thus set in the desired vertical and horizontal position by the action of the vertical-drive motor 50 and horizontal-drive motor 30 as described before focuses radio waves from a broadcasting satellite to the sub-reflector 3. The sub-reflector 3, in turn, reflects the radio waves to the converter 2, whereupon the primary radiator in the converter 2 senses the received radio waves. The circular-linear polarizer in the converter 2 converts the radio waves sensed by the primary radiator into linearly polarized waves. The converter 2 converts signals of the 12 GHZ band into BS-IF signals of the 1 GHZ band. The signals thus output from the converter 2 are delivered through the cord 20, rotary joint 21 and cord 29 into the vehicle where the information sent by satellite broadcasting is received. The adjusting screw 9d permits fine adjustment of the relative angle between the main reflector 1 and arm 9, while the adjusting screw 9g permits fine adjustment of the angle at which the sub-reflector 3 rises above the arm 9. By such fine vertical and horizontal adjustments, the most sensitive receiving position can be selected.

To collapse the main reflector 1 and arm 9, the horizontal-drive motor 30 is stopped when the main reflector 1 is found to face forward in the direction in which the vehicle advances by sensing the output from the light sensor 71. Then, the vertical-drive motor 50 is started to turn the main reflector 1 toward the cover 5 through angle $\psi$ from the position shown in FIG. 10. As the main reflector 1 turns, the spring 8 urges the arm 9 toward the cover 5. When the projection 3a on the sub-reflector 3 touches the cover 5, the sub-reflector 3 turns against the force of the spring 3c. In the end, the arm 9 is contained between the main reflector 1 and cover 5, with the sub-reflector 3 folded, as shown by a dash-and-two-dots line in FIG. 4. In this condition, the main reflector 1 covering the cover 5 forms a slight projection on the mounting panel 11 streamlined toward the front of the vehicle. In the collapsed condition, therefore, the whole assembly is not exposed to the strong wind pressure that might otherwise be unavoidable on the running vehicle. Totally covered with the main reflector 1, in addition, there is no risk of damaging the antenna with some external force.

While the relatively heavy converter 2 is mounted on the main reflector 1, the arm 9 carries only the relatively light sub-reflector 3. Therefore, the arm 9 needed be particularly reinforced. A relatively thin rod is enough. This permits reducing the size of the whole assembly. Because the moment set up by the sub-reflector 3 and arm 9 is small, the vertical-drive motor 50 needs no large driving capacity, thus permits power saving.

It should be understood that, although the preferred embodiment of the present invention has been described herein in considerable detail, certain modifications, changes, and adaptations may be made by those skilled in the art and that it is hereby intended to cover all modifications, changes and adaptations thereof falling within the scope of the appended claims.

What is claimed is:

1. A broadcasting receiver for vehicles which comprises:

a base plate disposed on a static portion of a vehicle for horizontal rotation about a vertical pivot axis, a main reflector for receiving and reflecting broadcasting signals fixed to a rotation shaft attached to said base plate for rotation about an axis perpendicular to said base plate vertical pivot axis between a turned down position overlying said base plate and a projected stand up position, an arm having one end attached to said base plate such that said arm is rotatable about a common axis with that of said rotation shaft, a sub-reflector for reflecting broadcasting signals reflected by said main reflector and rotatably attached to one end of said arm, a broadcasting signal detector attached to said main reflector for detecting signals reflected by said sub-reflector and transmitting them to the inside of the vehicle by means of a cord and, a mechanism for preventing said cord from being twisted by rotation of the base plate.

2. A broadcasting receiver for vehicles of claim 1, in which said mechanism for preventing the cord from being twisted comprises a rotary joint attached to the base plate and provided with a gear mechanism operatively responsive to rotation of said base plate which always acts to untwist the cord against the twisting action by rotation of the base plate.

3. A broadcasting receiver for vehicles of claim 1, in which said base plate is attached to a mounting plate of a vehicle body so as to be rotatable in a plane substantially parallel to said mounting plate.

4. A broadcasting receiver for vehicles of claim 1, in which said main reflector is so disposed as to cover the substantial entire surface of said base plate accommodating said arm and sub-reflector thereunder when the main reflector is rotated to the turned down position.

5. A broadcasting receiver for vehicles which comprises:

a base plate disposed on a static portion of a vehicle for horizontal rotation about a vertical pivot axis, a main reflector for receiving and reflecting broadcasting signals and being fixed to a rotation shaft attached to said base plate for rotation about an axis perpendicular to said base plate vertical pivot axis, an arm having one end attached to said base plate so that the arm is rotatable about a common axis with that of said rotation shaft, a sub-reflector for reflecting broadcasting signals reflected by said main reflector and rotatably attached to one end of said arm, a broadcasting signal detector attached to said main reflector for detecting signals reflected by said sub-reflector and transmitting them to the inside of the vehicle by means of a cord, an angle adjusting device for adjusting and maintaining said main reflector at a predetermined angle with respect to said arm when the main reflector is in a stand-up position, a device for causing said sub-reflector to stand up in relation to said arm so that the sub-reflector takes a predetermined angle position with respect to said main reflector, and said angle adjusting device comprising a first projection formed on the side of said main reflector and a second projection formed on the side of said arm and an adjustable screw which is screwed in said second projection and contacts said first projection.

6. A broadcasting receiver for vehicles of claim 5, in which said base plate is attached to a horizontal mounting plate of a vehicle body so as to be rotatable in a plane substantially parallel to said horizontal mounting plate.

7. A broadcasting receiver for vehicles of claim 5, in which said main reflector is so disposed as to cover the substantial entire surface of said base plate accommodating said arm and sub-reflector thereunder when the main reflector is at a turned down position.

8. A broadcasting receiver for vehicles which comprises:

a base plate disposed on a static portion of a vehicle so as to be horizontal and rotatable about a vertical axis, a main reflector for receiving and reflecting broadcasting signals and being fixed to a rotation shaft attached to said base plate for rotating about a horizontal axis perpendicular to said base plate vertical rotation axis, an arm having one end attached to said base plate so that the arm is rotatable around a common horizontal axis with that of said rotation shaft, a sub-reflector for reflecting broadcasting signals reflected by said main reflector and rotatably attached to one end of said arm, a broadcasting signal detector attached to said main reflector for detecting signals reflected by said sub-reflector and transmitting them to the inside of the vehicle by means of a cord, a mechanism for preventing said cord from being twisted by rotation of the base plate, and an angle adjusting device for adjusting and maintaining said main reflector at a predetermined angle to said arm when the main reflector is in a stand-up position, and a device for causing said sub-reflector to stand up in relation to said arm so that said sub-reflector takes a predetermined angle position to said main reflector.

9. A broadcasting receiver for vehicles of claim 8, wherein said mechanism for preventing the cord from being twisted comprises a rotary joint attached to the base plate and provided with a gear mechanism which always acts so as to untwist the cord against the twisting action by the base plate, and said angle adjusting device comprising a first projection formed on the side of main reflector and a second projection formed on the side of said arm and an adjustable screw which is screwed in said second projection and contacts said first projection.

* * * * *